US007308763B2

(12) United States Patent
Glodowski

(10) Patent No.: US 7,308,763 B2
(45) Date of Patent: Dec. 18, 2007

(54) SEALANT CUTTING TOOL WITH QUICK RELEASE, REPOSITIONABLE BLADE

(75) Inventor: Michael J Glodowski, Mary, ID (US)

(73) Assignee: Patents Holding Company, Lakewood, CO (US)

( * ) Notice: Subject to any disclaimer, the term of this patent is extended or adjusted under 35 U.S.C. 154(b) by 45 days.

(21) Appl. No.: 11/102,107

(22) Filed: Apr. 8, 2005

(65) Prior Publication Data

US 2006/0225289 A1 Oct. 12, 2006

(51) Int. Cl.
*B26B 5/00* (2006.01)
*B26B 1/10* (2006.01)

(52) U.S. Cl. ..... 30/294; 30/314; 30/334; 30/339; 30/340; 276/86; 276/91; 411/166; 411/172; 411/294; 411/327

(58) Field of Classification Search ..... 30/294, 30/314, 330, 334, 339, 340, 342; 279/76–84, 279/86, 89, 90, 91; 411/166, 172, 294, 327, 411/399, 949; 24/456, 461, 462, 494, 504, 24/514, 515, 516, 517
See application file for complete search history.

(56) References Cited

U.S. PATENT DOCUMENTS

| | | | | | |
|---|---|---|---|---|---|
| 97,833 | A * | 12/1869 | Tanner | 30/169 |
| 1,021,444 | A * | 3/1912 | Bates | 30/309 |
| 1,589,156 | A * | 6/1926 | Hartman | 30/294 |
| 1,865,539 | A * | 7/1932 | Pietzsch | 83/698.11 |
| 2,061,718 | A * | 11/1936 | Stahl | 269/232 |
| 2,346,364 | A * | 4/1944 | Dowe | 279/83 |
| 3,448,517 | A * | 6/1969 | Cothery | 30/140 |
| 4,575,940 | A * | 3/1986 | Wenzel | 30/335 |
| 4,750,267 | A * | 6/1988 | Boyd | 30/161 |
| 5,083,358 | A * | 1/1992 | Jones et al. | 29/525.11 |
| 5,383,383 | A * | 1/1995 | Garuglieri | 83/666 |
| 5,400,510 | A | 3/1995 | Glodowski | |
| 5,784,788 | A * | 7/1998 | Cothery | 30/294 |
| 6,256,889 | B1 * | 7/2001 | Zuro | 30/339 |

OTHER PUBLICATIONS

UltraWiz Cold Knives webpage: http://www.ultrawiztools.com/ColdKnives.htm.

* cited by examiner

*Primary Examiner*—Boyer D. Ashley
*Assistant Examiner*—Edward Landrum
(74) *Attorney, Agent, or Firm*—Swanson & Bratschun, L.L.C.

(57) ABSTRACT

A sealant cutting tool including a handle defining a blade slot. Also included is a clamping bolt having a clamp axis transverse the blade slot, which clamping bolt is threadably engaged with the handle. In addition, a "T" pull is operatively associated with the clamping bolt so that rotation of the "T" pull around the clamp axis causes a distal end of the clamping bolt to move relative to the blade slot. The sealant cutting tool may include a blade received in the blade slot in operative association with the clamping bolt. In addition, the "T" pull may include an engagement head operatively associated with a proximal end of the clamping bolt. The clamping bolt may include a noncylindrical shoulder received through a mating, noncircular opening formed in the engagement head. Thus, the noncircular opening may be selectively engaged with the noncylindrical shoulder, allowing the "T" pull to be selectively engaged or disengaged from the clamping bolt.

9 Claims, 3 Drawing Sheets

SEALANT CUTTING TOOL WITH QUICK RELEASE, REPOSITIONABLE BLADE

TECHNICAL FIELD

The present invention is directed toward a sealant cutting tool, and more particularly toward a sealant cutting tool for use in the auto glass replacement industry, featuring a quick release, repositionable blade.

BACKGROUND ART

It is often necessary for an auto glass technician to remove a vehicle windshield from its frame in order to replace or repair the windshield. Typically, vehicle windshields are installed in a frame by bonding the windshield to the frame with a polymer adhesive such as polyurethane. Therefore, whenever it becomes necessary to remove a windshield, it is necessary to cut through the adhesive seal in order to release the windshield.

Many types of sealant cutting tools are known in the auto glass industry which are more or less specifically configured to cut the seal around a vehicle windshield. One type of manual knife used for this purpose has a generally cylindrical handle with an essentially planar, pointed blade which is bent some distance from the handle at an approximately 90° angle relative to the axis of the handle. Thus, the point of the blade is disposed roughly perpendicular to the centerline of the handle. This type of knife is often named a "cold knife" to distinguish it from other tools used in the auto glass industry which are powered or use heat to aid with the process of breaking the seal between the frame and the windshield.

A great deal of force is necessary to pull a manual sealant cutting tool such as a cold knife through the adhesive seal between a windshield and frame. Accordingly, typical sealant cutting tools often have a second handle pivotally connected to the primary handle near the blade attachment point. The second handle is often "T" shaped, and allows the auto glass technician to use both hands in pulling the blade through the strong adhesive.

During the use of a manual sealant cutting tool as described above, blades often become dull, bent, or broken. In addition, it can be quite difficult or impossible to adjust the length of the portion of the blade extending from the handle to effectively cut through the entire adhesive seal surrounding a windshield while simultaneously avoiding scratching or otherwise marring the exterior finish of a vehicle or to quickly exchange blades of various lengths.

Industry standard blades for a sealant cutting tool as described above typically have an elongated, planar attachment base perforated with mounting holes. Many sealant cutting tools are designed such that multiple steps and separate tools are necessary to attach or remove the mechanism used to secure the blade to the handle of the knife. Since the blades often break or become dull, a great deal of auto glass technician time is spent disassembling a typical sealant cutting tool to remove replace blades. In addition, many sealant cutting tools use the blade mounting holes to attach the blade to the handle of the tool. Thus, the blades can only be attached at fixed positions or fixed extensions with respect to the handle of the knife.

Cothery, U.S. Pat. No. 5,784,788, and Zuro, U.S. Pat. No. 6,256,889, both describe sealant cutting tools for use in the auto glass industry which feature mechanisms which are designed to allow the quick release and replacement of a blade from the tool handle. However, both Cothery and Zuro feature many intricate, movable parts which must be precisely machined, increasing the cost of a sealant cutting tool with a quick release blade feature, and potentially increasing the amount of maintenance necessary to properly use the tool. In addition, the prior art quick release tools feature separate blade carriages which move with respect to the handle which may introduce unwanted flexure into the cutting process. Also, the prior art is specifically configured to be used with industry standard cold knife blades. Thus, the utility of the prior art cutting tools for use with a variety of other blades including utility knife blades or pinchweld scrapers, for example, is limited.

The present invention is directed toward overcoming one or more of the problems discussed above.

SUMMARY OF THE INVENTION

One aspect of the present invention is a sealant cutting tool including a handle defining a blade slot. Also included is a clamping bolt having a clamp axis transverse the blade slot, which clamping bolt is threadably engaged with the handle. In addition, a "T" pull is operatively associated with the clamping bolt so that rotation of the "T" pull around the clamp axis causes a distal end of the clamping bolt to move relative to the blade slot.

The sealant cutting tool may include a blade received in the blade slot in operative association with the clamping bolt. In addition, the "T" pull may include an engagement head operatively associated with a proximal end of the clamping bolt. In one aspect of the present invention, the clamping bolt may include a noncylindrical shoulder received through a mating, noncircular opening formed in the engagement head. Thus, the noncircular opening may be selectively engaged with the noncylindrical shoulder, allowing the "T" pull to be selectively engaged or disengaged from the clamping bolt.

Another aspect of the present invention includes a handle, a first wall formed in the handle and a second wall formed in the handle parallel to the first wall such that the first wall and the second wall define a blade slot. Also included is a threaded bore defined by the handle extending along a clamp axis transverse the first wall from an exterior surface of the handle through the first wall. In addition, a clamping bolt is received in the threaded bore, the clamping bolt having a proximal end extending beyond the exterior surface of the handle and a distal end adjacent to the first wall. The clamping bolt also includes a threaded shaft between the proximal end and the distal end. In addition, a "T" pull operatively associated with the proximal end of the clamping bolt is included. The "T" pull is configured such that rotation of the "T" pull around the clamp axis rotates the clamping bolt within the threaded bore, and causes the distal end of the clamping bolt to move relative to the blade slot. In use, rotation of the "T" pull around the clamp axis in a first direction causes the distal end of the clamping bolt to move into the blade slot, clamping a blade between the distal end of the clamping bolt and the first wall or the handle. Rotation of the "T" pull around the clamp axis in an opposite second direction causes the distal end of the clamping bolt to move out of the blade slot, releasing the blade. Thus, blades may be changed or repositioned by an auto glass technician by simply actuating the "T" pull and clamping bolt and moving or replacing the blade. Thus, no tools are necessary to move or replace a blade. In addition, a blade may be clamped at any position along its length, allowing the distance between the point of the sealant cutting tool and the handle to be selectively adjusted by the auto glass technician.

Another aspect of the present invention is a method of mounting a blade to a sealant cutting tool as described above.

DETAILED DESCRIPTION OF THE PREFERRED EMBODIMENT

Figure 1:
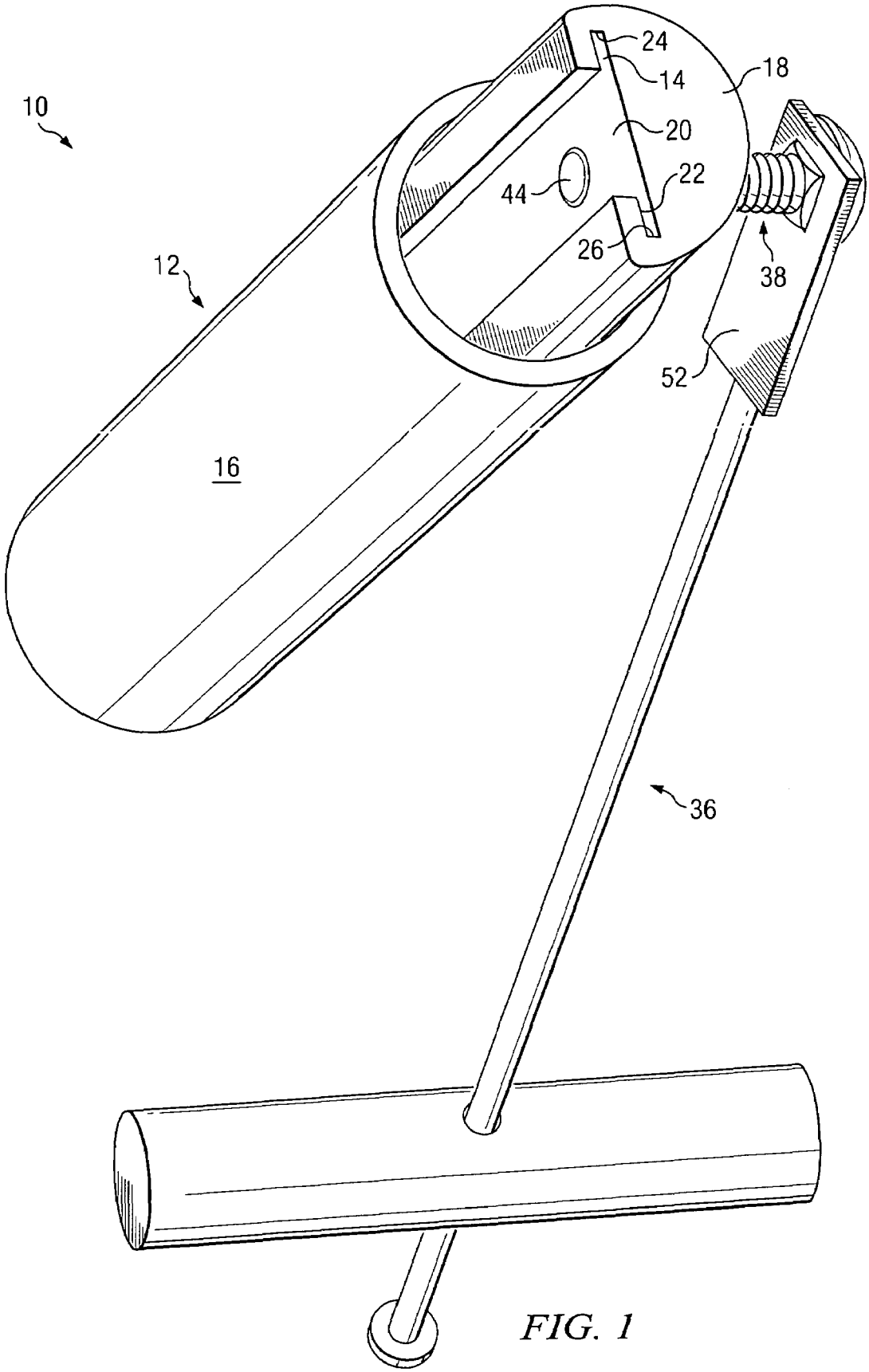
FIG. 1 is a perspective view of an embodiment of the present invention.

An embodiment of the present invention is shown in perspective view in FIG. 1. The sealant cutting tool 10 includes a handle 12 defining a blade slot 14. In the embodiment shown in FIG. 1, the handle 12 is formed from a hollow, cylindrical outer structure 16 and a solid, semicylindrical inner structure 18 which are permanently joined together. The present invention is not limited to the two part handle configuration or shape shown in FIG. 1; equally suitable shaped, i.e. square or elliptical handles, could be fabricated from one or multiple parts.

In the embodiment shown in FIG. 1, the blade slot 14 is machined in the solid, semicylindrical inner structure 18 of the handle 12. The present invention is not limited to embodiments where the blade slot 14 is machined directly into the handle. For example, multiple handle subcomponents could be assembled to define a blade slot 14. Alternatively, the blade slot 14 could be formed by procedures other than machining.

Figure 2:
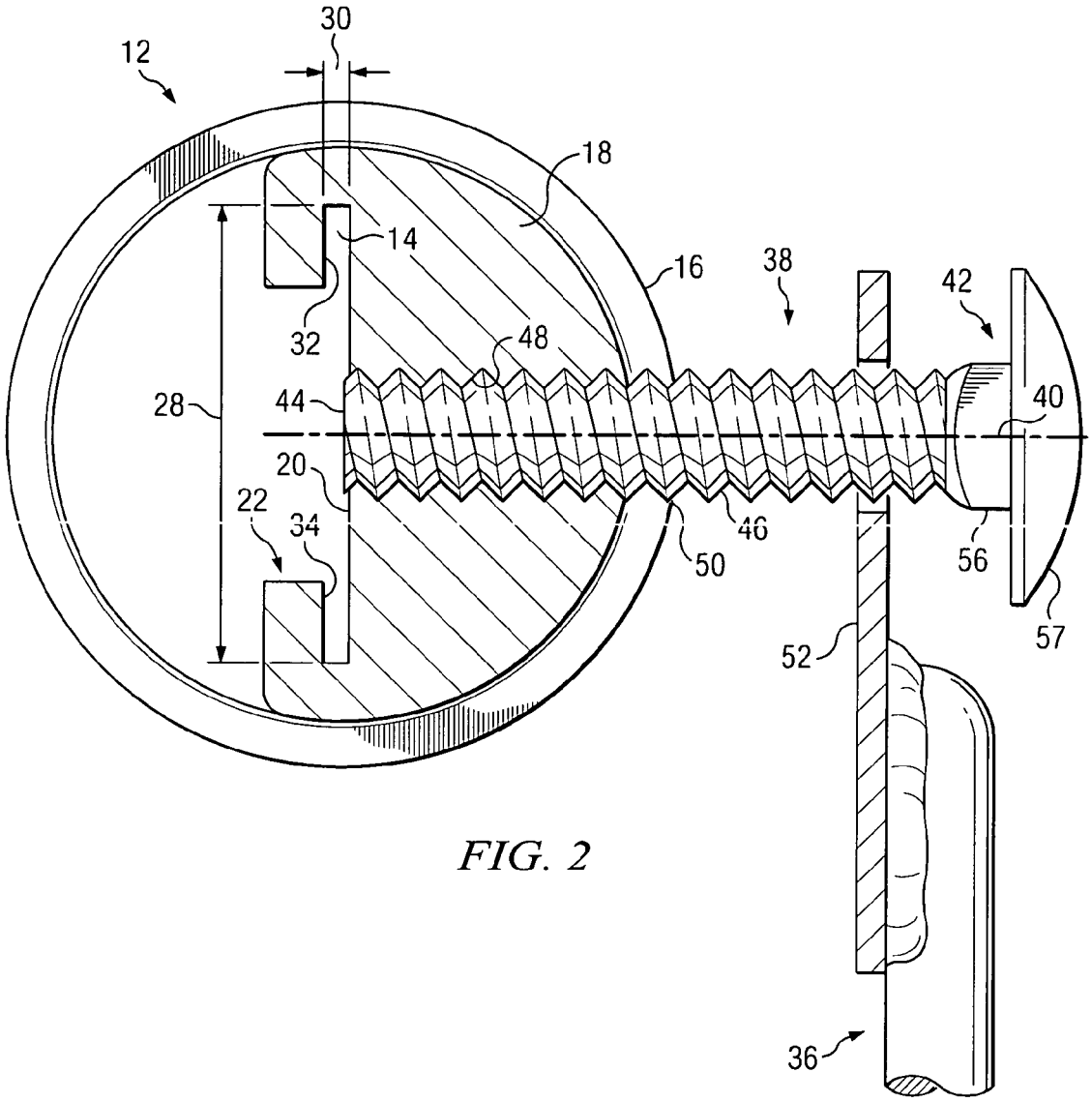
FIG. 2 is a cutaway view of an embodiment of the present invention taken along line A-A of FIG. 3.
Figure 3:
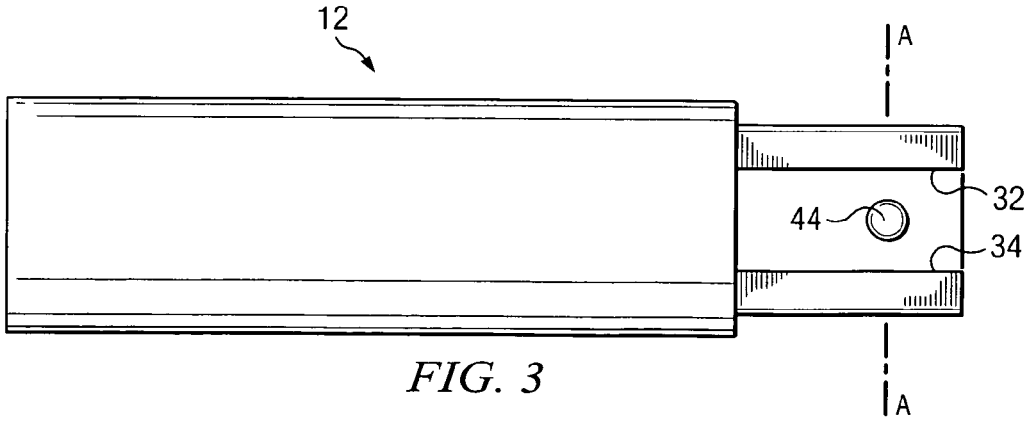
FIG. 3 is a side plan view of an embodiment of the present invention.

The blade slot 14 may have a first wall 20, a second wall 22, a top wall 24, and a bottom wall 26. Together, the walls 20, 22, 24, 26 of the blade slot 14 define a select blade slot height 28 and blade slot width 30. The walls 20, 22, 24, 26, blade slot height 28, and blade slot width 30 are best viewed in the cutaway view of FIG. 2 which is taken along line A-A of the side plan view of the handle 12 of FIG. 3. As is also shown in FIG. 3, the second wall 22 may be divided into an upper subwall 32 and a lower subwall 34.

Figure 4:
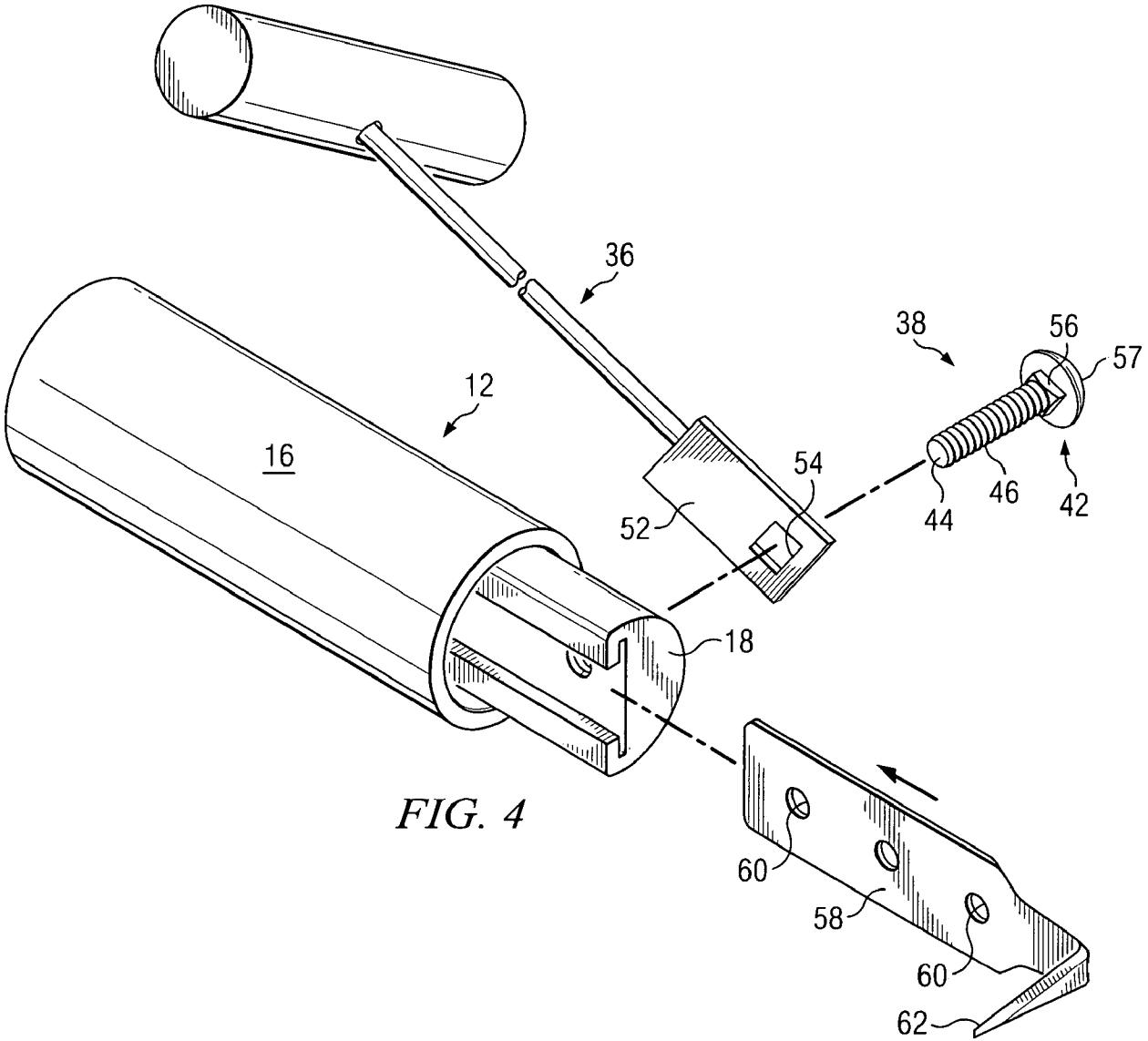
FIG. 4 is an exploded view of an embodiment of the present invention.

Returning to FIG. 1 and the exploded view of FIG. 4, the sealant cutting tool 10 also includes a "T" pull 36. The "T" pull 36 is operatively associated with a clamping bolt 38 which, as is best shown in FIG. 2, is threadably engaged with the handle 12. The clamping bolt 38 has a clamp axis 40 which is transverse the blade slot 14. In addition, the clamping bolt 38 may include a proximal end 42, a distal end 44, and a threaded shaft 46 between the proximal end 42 and distal end 44.

The clamping bolt 38 is received within a threaded bore 48 which extends along the clamp axis 40 from an exterior surface 50 of the handle 12 through the first wall 20. Thus, the threaded bore 48 communicates with the blade slot 14. When the clamping bolt 38 is placed in an operative position as shown in FIG. 2. The proximal end 42 of the clamping bolt 38 is positioned outside the exterior surface 50 of the handle 12 and the distal end 44 of the clamping bolt 38 is positioned adjacent to the blade slot 14 and first wall 20.

Figure 5:
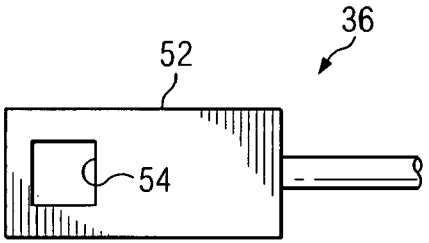
FIG. 5 is a side plan view of an engagement head in accordance with the present invention.
Figure 6:
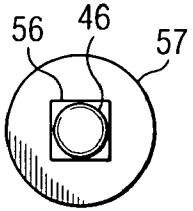
FIG. 6 is a distal end plan view of a clamping bolt in accordance with the present invention.

The "T" pull 36 is operatively associated with the proximal end 42 of the clamping bolt 38 such that rotation of the "T" pull 36 around the clamp axis 40 by an auto glass technician causes the distal end 44 of the clamping bolt 38 to move relative to the blade slot 14. The "T" pull 36 may include an engagement head 52 which is shown in detail in FIG. 5. The engagement head 52 may have a noncircular hole 54 through the engagement head 52. The noncircular hole 54 is sized to fit loosely over the threaded shaft 46 portion of the clamping bolt 38. In this configuration, the clamping bolt 38 may have a noncylindrical shoulder 56 at the proximal end 42 configured to make a mating engagement with the noncircular hole 54 of the engagement head 52. The noncylindrical shoulder 56 is clearly shown in the distal end plan view of the clamping bolt 38 in FIG. 6. The clamping bolt 38 may also include a bolt head 57 sized to prevent removal of the engagement head 52 from the proximal end 42 of the clamping bolt 38. The operative orientation of the engagement head 52 with the clamping bolt 38 is shown in FIG. 2 where it is shown that the clamping bolt 38 is received through the noncircular hole 54 of the engagement head 52. This configuration allows the "T" pull 36 to be selectively engaged with the clamping bolt 38 such that rotation of the "T" pull 36 around the clamp axis 40 rotates the clamping bolt 38 within the threaded bore 48. Similarly, the "T" pull 36 may be selectively disengaged with the clamping bolt 38 such that rotation of the "T" pull 36 around the clamp axis 40 does not rotate the clamping bolt 38 within the threaded bore 48. The present invention is not limited to embodiments featuring a noncylindrical shoulder 56 and a mating noncircular hole 54 formed in an engagement head 52. Other structures may be employed to connect the "T" pull 36 with the clamping bolt 38 in the operative orientation described herein.

The exploded view of FIG. 4 shows a typical "cold knife" blade 58 which includes a plurality of holes 60. These holes 60 are utilized in various prior art sealant cutting tool designs to secure the blade to a handle or knife body. The present invention allows the blade 58 to be clamped by the distal end 44 of the clamping bolt 38 at any position along the length of the blade 58 structure. Thus, the quick release design of the present invention allows an auto glass technician to selectively choose the distance the point 62 of a knife blade 58 is positioned from the handle 12.

In use, an auto glass technician will clamp a blade 58 to the sealant cutting tool 10 by placing a blade 58 into the blade slot 14 in an operative relationship with the clamping bolt 38. The technician may then rotate the "T" pull 36 around the clamp axis 40 in a first direction causing the distal end 44 of the clamping bolt 38 to move into the blade slot 14, clamping the blade 58 between the distal end 44 of the clamping bolt 38 and the handle 12. Thus, the attachment of a blade 58 is accomplished quickly and without the need to use separate tools. In embodiments having structure allowing the "T" pull 36 to be selectively engaged or disengaged from the clamping bolt 38, such as the engagement head 52 and clamping bolt 38 with a noncylindrical shoulder 56 shown in FIGS. 5 and 6, the technician may easily disengage the "T" pull 36 from the clamping bolt 38 to allow the sealant cutting tool 10 to be used without risk of loosening the blade 58. When a blade 58 becomes bent, broken, or dull, or when it is desirable to change the distance between the point 62 of the blade 58 and the handle 12, a technician may simply reengage the "T" pull 36 with the clamping bolt 38. Then, rotation of the "T" pull 36 around the clamp axis 40 in the opposite direction will cause the distal end 44 of the clamping bolt 38 to move away from the blade 58, releasing the blade 58. Once released, the blade 58 may be easily repositioned or replaced.

The sealant cutting tool 10 is not limited to use with industry standard cold knife blades. Other types of blades which are suitably sized to fit within the blade slot 14 may also be used. Other blades include traditional straight utility knife blades, specialized saw blades, pinchweld scrapers, or other types of blade.

While the invention has been particularly shown and described with reference to a number of embodiments, it would be understood by those skilled in the art that changes in the form and details may be made to the various embodiments disclosed herein without departing from the spirit and scope of the invention and that the various embodiments disclosed herein are not intended to act as limitations on the scope of the claims.

What is claimed is:

1. A sealant cutting tool comprising:

a handle defining a blade slot;

a clamping bolt having a clamp axis transverse the blade slot; the clamping bolt threadably engaging the handle; and a separate and independently movable T pull operatively associated with the clamping bolt such that rotation of the T pull around the clamp axis selectively causes a distal end of the clamping bolt to move relative to the blade slot wherein the T pull comprises an engagement head operatively associated with a proximal end of the clamping bolt, and wherein the clamping bolt comprises a non-cylindrical shoulder and the clamping bolt is received through a mating non-circular opening formed in the engagement head, such that the non-circular opening selectively engages the non-cylindrical shoulder.

2. A sealant cutting tool of claim 1 further comprising a blade received in the blade slot in operative association with the clamping bolt.

3. A sealant cutting tool comprising a handle;

a first wall formed in the handle;

a second wall formed in the handle planar parallel to the first wall such that the first wall and the second wall define a blade slot;

a threaded bore defined by the handle, the threaded bore extending along a clamp axis transverse the first wall from an exterior surface of the handle through the first wall;

a clamping bolt received in threaded bore, the clamping bolt having a proximal end extending beyond the exterior surface of the handle, a distal end adjacent to the first wall and a threaded shaft between the proximal end and the distal end; and a separate and independently movable T pull operatively associated with the proximal end of the clamping bolt such that rotation of the T pull around the clamp axis selectively rotates the clamping bolt within the threaded bore and causes the distal end of the clamping bolt to move relative to the blade slot, wherein the T pull comprises an engagement head operatively associated with the proximal end of the clamping bolt, and wherein the clamping bolt comprises a non-cylindrical shoulder and the clamping bolt is received through a mating non-circular opening formed in the engagement head, such that the non-circular opening may be selectively engages the non-cylindrical shoulder.

4. The sealant cutting tool of claim 3 further comprising a blade received within the blade slot.

5. The sealant cutting tool of claim 3 further comprising a top wall and a bottom wall defined by the handle, the top wall and the bottom wall defining a select blade slot height.

6. The sealant cutting tool of claim 3 wherein the second wall is divided into upper and lower sub-walls.

7. The sealant cutting tool of claim 3 wherein the T pull may be selectively engaged with the clamping bolt such that rotation of the T pull around the clamp axis rotates the clamping bolt within the threaded bore, and the T pull may be selectively disengaged with the clamping bolt while remaining operatively associated with the clamping bolt such that rotation of the T pull around the clamp axis does not rotate the clamping bolt within the threaded bore.

8. The sealant cutting tool of claim 3 wherein the threaded shaft of the clamping bolt extends a select length beyond the exterior surface of the handle and has a shaft diameter sufficiently small that the non-circular opening may be selectively rotated around the threaded shaft without engaging the clamping bolt.

9. The sealant cutting tool of claim 3 further comprising a clamping bolt head sized to prevent removal of the engagement head from proximal end of the clamping bolt.

* * * * *